United States Patent [19]

Putnam

[11] 4,417,868

[45] Nov. 29, 1983

[54] COMPACT PLENUM FOR PULSE COMBUSTORS

[75] Inventor: Abbott A. Putnam, Columbus, Ohio

[73] Assignee: Battelle Development Corporation, Columbus, Ohio

[21] Appl. No.: 299,567

[22] Filed: Sep. 4, 1981

[51] Int. Cl.[3] ..... F23C 11/04

[52] U.S. Cl. ..... 431/1; 431/114; 60/249; 181/229; 181/281; 239/553.5; 239/590.5

[58] Field of Search ..... 431/1, 114, 188, 278; 239/553.5, 590.5; 60/249, 39.77; 181/214, 224, 229, 281

[56] References Cited

U.S. PATENT DOCUMENTS

| | | | |
|---|---|---|---|
| 2,525,782 | 10/1950 | Dunbar | 60/249 |
| 2,882,993 | 4/1959 | Murty | 181/281 |
| 2,914,133 | 11/1959 | Johnson | 181/229 |
| 4,109,751 | 8/1978 | Kabele | 181/229 |

FOREIGN PATENT DOCUMENTS

| | | | |
|---|---|---|---|
| 1131921 | 4/1955 | France | 181/281 |
| 1174684 | 12/1969 | United Kingdom | 431/1 |

*Primary Examiner*—Samuel Scott
*Assistant Examiner*—Randall L. Green
*Attorney, Agent, or Firm*—Barry S. Bissell

[57] ABSTRACT

The physical size of an inlet plenum (2) for a cluster of pulse combustors (1) may be reduced while maintaining a tuned condition for noise cancellation by constructing the plenum with an annular chamber (8) having internal baffles (20, 21) which make the acoustic path length through the annular plenum (2) substantially larger than its circumference.

6 Claims, 4 Drawing Figures

COMPACT PLENUM FOR PULSE COMBUSTORS

BACKGROUND OF THE INVENTION

A pulse combustor typically comprises a combustion chamber, air and fuel inlets and an exhaust duct or resonance tube. A pulse combustor cycle consists of an explosion in the combustion chamber forcing combustion products out the exhaust duct, the consequent drawing of fuel and air into the evacuated combustion chamber and the ignition of the fresh fuel mixture by residual hot gases to complete the cycle. Backflow of exhaust gases out the air inlet is suppressed by mechanical or aerodynamic valves on the air inlet. The unit cycles close to its natural acoustic frequency.

The pulse combustor is an efficient heating device because of the high flow rates or high pressure boost of the exhaust gases. This results in high heat transfer rates in the resonance tube and the ability to use a compact, efficient heat exchanger in removing large quantities of heat.

The well known disadvantages of vibration and noise have thus far prevented the wide spread use of pulse combustors despite their high efficiency and other advantages. Use of exhaust and inlet mufflers has been suggested to reduce noise. The present inventor has also suggested the use of multiple pulse combustor units which are joined to operate out of phase and thereby provide acoustic cancellation of noise. The suggestion appears in a paper entitled "General Survey of Pulse Combustion," in Proceedings of the First International Symposium on Pulsating Combustion, Sept. 20-23, 1971, University of Sheffield S1 3JD, England. Another paper by the inventor entitled "A Review of Pulse-Combustor Technology" presented at a symposium on Pulse Combustor Technology for Heating Applications at Argonne National Laboratory, Nov. 29-30, 1979, also surveys pulse combustors.

Other related information is contained in the U.S. Pat. Nos. 2,515,644 Goddard; 2,525,782 Dunbar; 2,546,966 Bodine; 2,878,790 Paris; 2,911,957 Kumm; 2,998,705 Porter; 3,118,804 Melenric; 3,267,985 Kitchen; 3,323,304 Llobet; 3,365,880 Grebe; 3,498,063 Lockwood; 3,792,581 Handa, and 4,033,120 Kentfield.

SUMMARY OF THE INVENTION

When coupling two or more pulse combustors for effecting noise cancellation, the combustors may be joined at one of several locations. When joining the air inlets, the shared inlet plenum supplying air should be tuned to the pulse combustors such that the fundamental acoustic spinning mode therein matches the frequency of the pulse combustors. This requirement would necessitate a (cylindrical) plenum of circumference equal to 1.84 wavelengths of the compressional wave in the plenum. Even for a thin annulus, the circumference should equal one wavelength. This results in a problem for pulse combustors of lower frequency because the plenum would be impractically large.

It is an object of the invention therefore to provide a low-noise pulse combustor system.

It is further an object to provide the low-noise system based on coupled pulse combustors which operate out of phase to acoustically cancel the noise from one another.

It is particularly an object to provide a novel air inlet plenum which provides air and is tuned to the coupled pulse combustors for effecting noise cancellation, but which is much smaller in circumference than one or two wavelengths of the acoustic wave developed in the plenum.

In accordance with the objectives, the invention is a compact inlet plenum for a plurality of pulse combustors and the low-noise pulse combustion system utilizing the compact plenum. The plenum comprises a housing forming an annular air chamber about a central axis, the annular chamber having an average perimeter substantially less than the velocity of sound divided by the natural acoustic frequency of the pulse combustors ($^{v}s/f$), means connecting the annular chamber with a source of air and with the inlets of the pulse combustors, and internal baffles in the annular chamber creating a circuitous acoustic path therearound of length greater than the average perimeter of the annular chamber. Preferably, the plenum is generally cylindrical and the baffles are arranged to construct an acoustic path length substantially equal to $^{v}s/f$. The plenum is generally constructed such that the air enters from the central axis and travels through an elongated supply tube to reach the annular chamber and thence the pulse combustor inlets.

DESCRIPTION OF THE INVENTION

Pulse combustors may be used as thrust-producing devices (as in the V-1 buss bomb), or as direct or indirect heating devices utilizing the hot exhaust gases. The compactness and the ability to pump its own air without blowers or motors is causing a reevaluation of the pulse combustor for furnace and boiler use. Reduction of the noise and vibration are uppermost in the minds of investigators.

Figure 1:
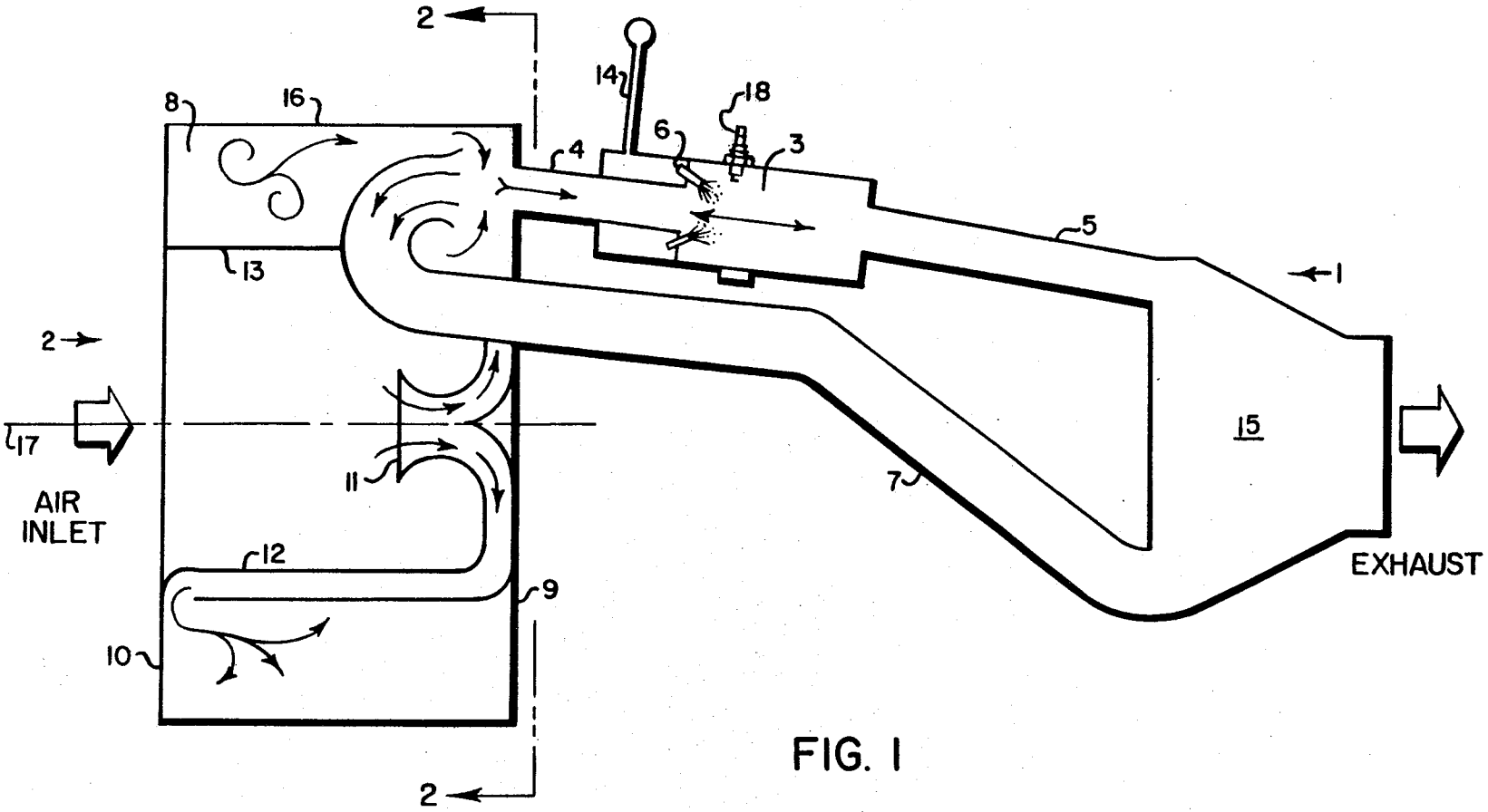
FIG. 1 is a schematic of a typical pulse combustor positioned on the inventive plenum.

A typical pulse combustor 1 is shown in FIG. 1 and consists of an aerodynamic air inlet 4, a combustion region 3 and a resonance or exhaust tube 5. A portion of the inlet air may be drawn through secondary air tube 7 to complete combustion of exhaust gases in a secondary combustion region 15 before they are expelled to the air. Several pulse combustors operating in cooperation may be connected with one secondary combustion region.

As is known in the art, the operation of the pulse combustor comprises a cycle beginning with the admission of fuel through fuel port 14 and fuel jets 6 connected to a source of fuel (not shown) and air through air inlet 4 from air plenum 2. The fuel/air mixture is initially ignited by means of spark plug 18 and the explosion drives the exhaust gases out through the resonance tube 5. Exhaust flow out the air inlet 4 is restricted by an aerodynamic valve, as shown, or by a mechanical or rotary valve. With the aerodynamic valve, the backflow gas jet aspirates secondary air through the secondary air tube 7 which supplies air to the secondary combustion region 15 and encourages the afterburning therein. The momentum built up in the departing exhaust gases creates low pressure in the combustion chamber which draws in fresh air and fuel. The cycle is completed when the fresh fuel mixture is ignited by residual hot reaction products. The spark plug may be disconnected after warm-up.

The unit operates close to its natural acoustic frequency. The frequency is not significantly affected by the rate of fuel input, but more by design parameters such as the length of the resonance tube 5. The pressure wave produced by each explosion produces a pressure node at the exhaust tube exit and a pressure antinode within the combustion chamber.

The method previously suggested by the inventor for reducing noise of pulse combustors comprises coupling of the combustion chambers or air inlets of multiple pulse combustors and forcing the units to run out of phase. Two joined pulse combustors would run 180 degrees out of phase, whereas three would be designed to run 120 degrees out of phase, etc. The pulse combustors may be coupled, for example, through an air inlet plenum or a conduit joining combustion chambers, etc. The pulse combustors should have similar natural acoustic frequencies for smooth combustion. A small difference is acceptable because the unit will tend to force the pulse combustors to run at a single frequency.

Figure 2:
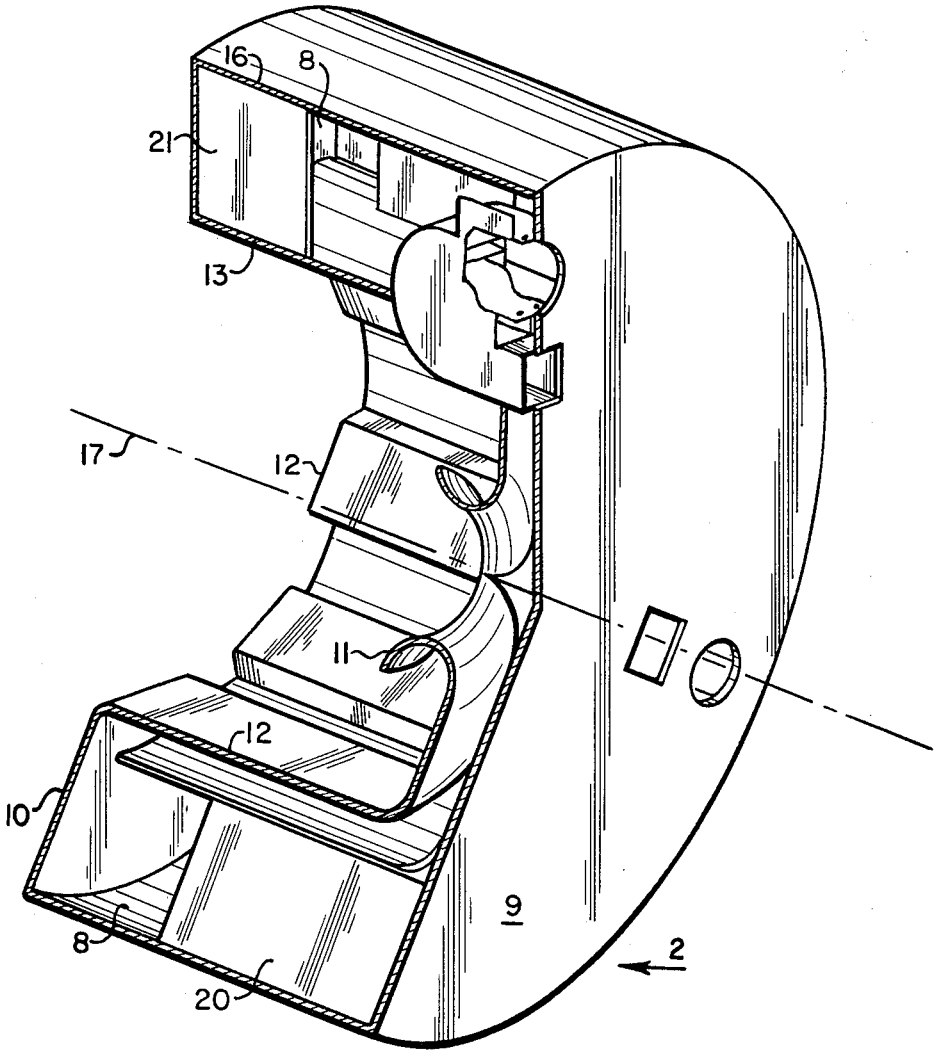
FIG. 2 is a broken isometric view of the inventive plenum showing an arrangement of pulse combustors and air inlets.
Figure 3:
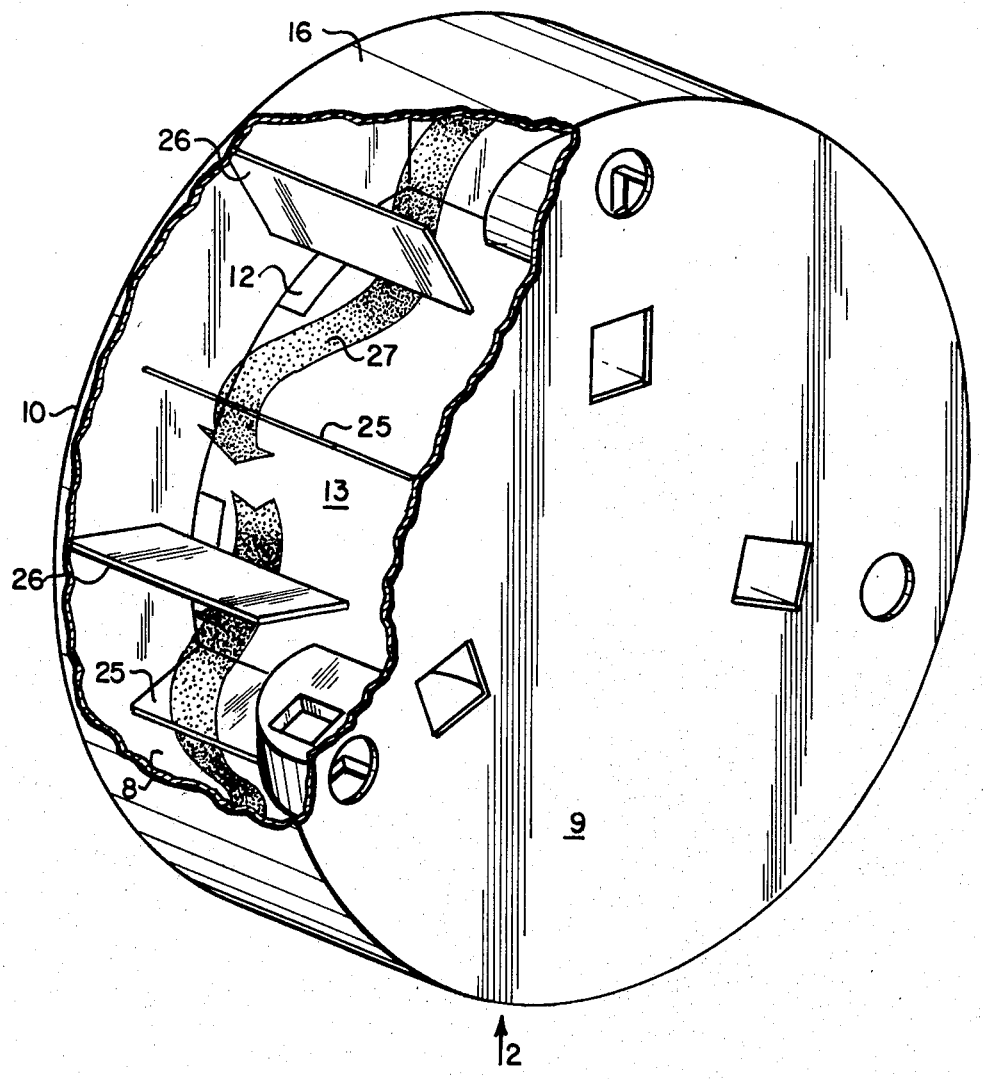
FIG. 3 and FIG. 4 are broken isometric views of two embodiments of the air plenum showing the internal baffling to increase the acoustic path length.
Figure 4:
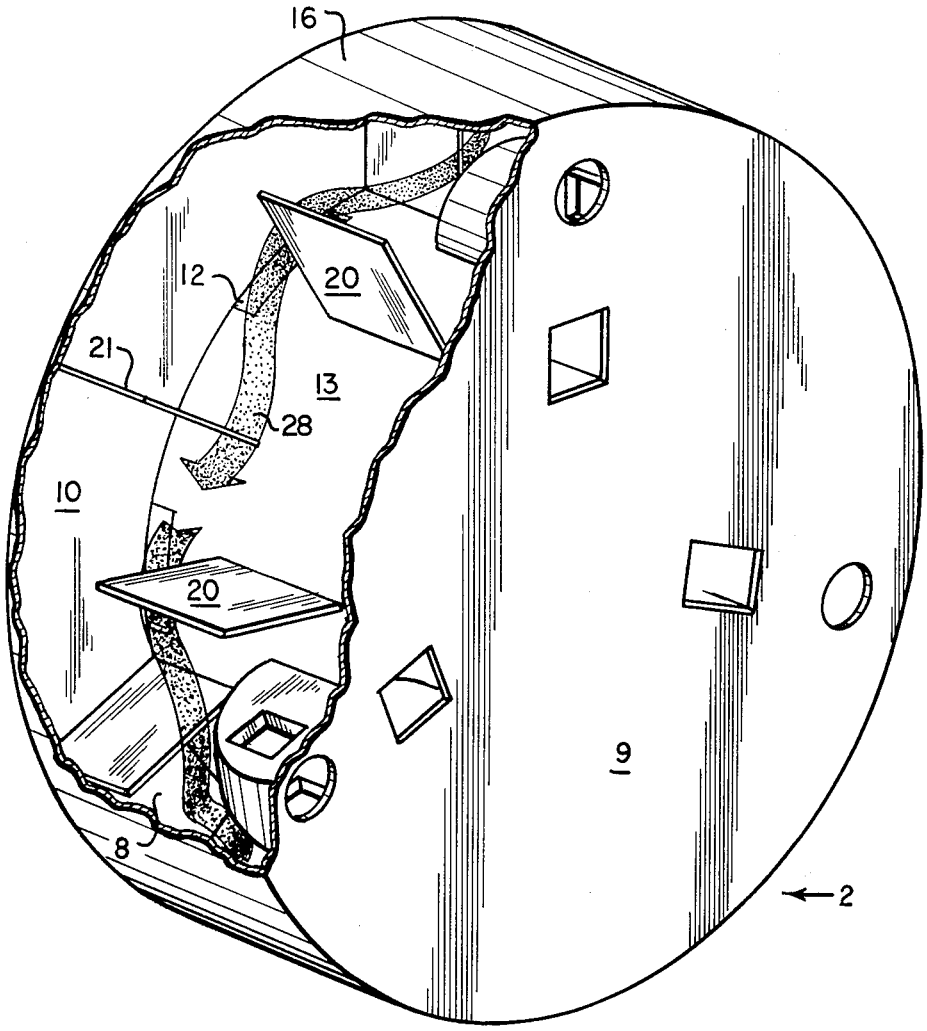

An arrangement for coupling three pulse combustors through an air plenum is shown in FIGS. 2–4, but two or more can be used. A common air inlet plenum 2 is tuned to resonate in a spinning mode at the operating frequency, f, of the pulse combustors 1. Typically, the pulse combustors fire at a frequency of from fifty up to a few hundred hertz. The combustors are arranged to fire in sequence around the circle. The air inlet plenum 2 is designed in relation to the air-ingestion rate of the combustors and the size of the air inlet 4 so that a pressure wave proceeds around the circle of pulse combustors in a fixed phase relationship to the sequential firing of the pulse combustors. It is to be emphasized that it is a pressure wave and not a physical flow of the gas in the inlet plenum, that characterizes the spinning motion. There is a substantially steady flow of air through the plenum air entrance 11, and substantial noise cancellation is obtained acoustically, without the need for a muffler.

The annular air inlet plenum 2 is tuned to resonate at the pulse combustor natural frequency, f, when the acoustic path for the pressure wave around the plenum is about one wavelength long or $v_s/f$, $v_s$ being the speed of sound. If the frequency of the pulse combustor is in the range of 200 hz, for example, the plenum should have an acoustic path length $$\lambda = (344 \text{ m/sec}/200 \text{ cycles/sec}) = 1.72 \text{ meters}$$

Without the invention, the circumference of an annular plenum should be about 1.72 meters for maintaining resonance and for a cylindrical plenum should be $1.84\lambda$ or about 3.13 meters. However, utilizing the present invention, the plenum can be reduced in size considerably, as will hereinafter be described while the acoustic path length remains long enough to maintain resonance.

Prior to the invention the air inlet plenum in the above example would typically be a low profile cylinder. Typically, the pulse combustors would be joined on the base of the cylinder near the perimeter and the plenum air entrance would be near the cylinder axis on the opposed base. This arrangement is desirable because of the existence, during operation, of a relative acoustic pressure minimum near the central axis (which reduces noise output) and a relative acoustic pressure maximum near the perimeter (which is involved in a pressure boost to the pulse combustors). The air supply path length would be equal to the distance from the plenum air entrance to the pulse combustors which is, of course, equal to the radius of the plenum. Multiple pulse combustors are typically equally spaced around the perimeter in order to obtain smooth combustion and good noise cancellation.

Now looking at FIGS. 2–4, it can be seen that the air inlet plenum is a novel modification of the prior plenum which desirably retains the operating characteristics of its larger predecessor. The inventive air inlet plenum resembles the prior art plenum with the cylindrical volume about the center removed and the diameter of the remainder reduced. What's left is an annular chamber 8 defined by cylindrical inner and outer walls 13, 16 and upper surface 9 and lower annular surface 10.

Air enters the air inlet plenum near the central axis 17 through plenum air entrance 11 and then through conduits 12. The air entrance 11 can be located near either side of the plenum and the conduits 12 can enter the annular chamber at any location. However, it is preferred that the arrangement be as shown in FIG. 2 wherein the entrance is near the upper surface 9 and the conduits 12 move the inlet air to the annular chamber 8 near the lower annular surface 10. This extended air path through conduits 12 simulates the extended path along which the air must travel from the plenum entrance to the pulse combustors in the large prior plenums (i.e. the radius of the larger plenums).

The diameter and circumference of the inventive plenum are reduced considerably over the prior devices. For example, the diameter of the earlier 3.2 meter circumference (cylindrical) plenum can be reduced to about 40 cm. To compensate for such reduction, the acoustic path length around the annular chamber is increased by means of baffles in the annular chamber. For example, as seen best in FIG. 3, radially outward baffles 25 and radially inward baffles 26 form a circuitous acoustic path 27 around the annular chamber 8. In FIG. 4, upper baffles 20 and lower baffles 21 alternate to form a circuitous acoustic path 28. These are but two of many ways included in the scope of the invention for baffling the annular chamber to increase the acoustic path length to a value larger than the circumference of the air inlet plenum. Preferably, the baffles are used to increase the acoustic path length to about $v_s/f$ which provides optimum tuning for noise suppression.

FIG. 2 shows a break-away isometric view of the inlet plenum and axially disposed baffles according to the invention. In the plenum shown, three pulse combustors may be arranged as shown and six conduits 12 are spaced around the pulse combustors and around wall 13 to supply air from the plenum entrance 11 to the annular chamber 8. The number and position of the conduits does not appear critical as long as they are sufficient to provide enough air to the combustors.

The air inlet plenum has been described as being generally cylindrical in external shape. This is the preferred shape, however, plenums having rectangular, square or other polygonal cross-sections may also be used in practicing the invention. Customary fuels such as hydrocarbon gases and liquids may be used.

Example of a 3 P/C Unit

Three pulse combustors may be joined to the inventive inlet plenum in the manner shown in FIGS. 1 and 2.

The pulse combustors should be substantially identical. For example, they may consist of a 2.5 cm diameter, 10 cm long aerodynamic inlet valve and swirl vane section leading to a 6.25 cm diameter, 10 cm long combustion chamber. The outlet side may consist of a 95 cm resonance tube of 2.5 cm diameter, gradually enlarging to 3.9 cm diameter over the last 27.5 cm. A flexible secondary air conduit of about 2 cm inside diameter may be used to draw secondary air for second stage combustion in each pulse combustor. The three resonance tubes and three secondary air conduits may be all joined at a secondary combustion chamber such as shown at 15 in FIG. 1.

Each pulse combustor described above typically has a fundamental frequency of about 200 Hz using a propane fuel input of between about 100,000 and 300,000 Btu/hr.

The three pulse combustors should be joined on the annular air plenum as shown in FIG. 2. For the acoustic spinning mode to match the pulse combustors, a conventional cylindrical air plenum would need a perimeter slightly larger than (1.84) ($^{v}s/f$) or about 3.13 meters. The inventive annular air plenum, however, may be constructed to be just 42 cm inside diameter and 25.4 cm high. The annular chamber may be 7.3 cm wide. Twelve baffles are positioned symmetrically as shown in FIG. 4 to produce the desired acoustic path length.

The pulse combustors may be charged with propane and a spark plug used to initiate combustion. The spark plug can then be turned off as the unit becomes hot. Afte a start up period the unit may be run, for example, at 300,000 Btu/hr. The individual pulse combustors are tuned to run 120° out-of-phase so that the noise from each unit is cancelled in part by the noise of the other pulse combustors. The total noise at the fundamental frequency is then reduced by an amount limited only by the necessary finite size of the air inlet and imperfections in construction. The reduction of the various harmonics depends in part on the number of individual pulse combustors in a cluster; a greater number of combustors being better able to cancel the noise.

I claim:

1. A combustion system comprising a plurality of pulse combustors having air inlets, fuel inlets, combustion chambers and exhaust outlets and having substantially equal natural acoustic frequencies, f, said air inlets being commonly joined to an inlet plenum wherein said inlet plenum comprises (A) housing means forming an annular chamber, the outer perimeter of which is substantially less than $^{v}s/f$, where $^{v}s$ equals the speed of sound (B) means connecting the annular chamber with the air inlets of the pulse combustors, (C) means for admitting a source of oxygen to the annular chamber, and (D) baffling means in the annular chamber creating a circuitous acoustic path therearound of length substantially equal to $^{v}s/f$.

2. The combustion system of claim 1 wherein the means connecting the annular chamber with the air inlets of the pulse combustors are substantially equally spaced around the annular chamber.

3. The combustion system of claim 1 wherein the means for admitting a source of oxygen comprises a plenum air entrance located substantially on the axis of the annular chamber.

4. The combustion system of claim 3 wherein the means for admitting a source of oxygen further comprises means for moving a source of oxygen from the plenum air entrance to the annular chamber.

5. The combustion system of claim 3 wherein the inlet plenum has an upper base and a lower base and wherein the means connecting the annular chamber with the pulse combustor air inlets are substantially equally spaced on the upper base and wherein the plenum air entrance is also located near the upper base.

6. A combustion system comprising a plurality of pulse combustors having air inlets, fuel inlets, combustion chambers and exhaust outlets and having substantially equal natural acoustic frequencies, f, said air inlets being commonly joined to an inlet plenum wherein said inlet plenum comprises (A) housing means forming an annular chamber bounded by upper and lower bases the outer perimeter of which is substantially less than $^{v}s/f$, where $^{v}s$ equals the speed of sound (B) means substantially equally spaced on the upper base for connecting the annular chamber with the air inlets of the pulse combustors, (C) means for admitting a source of oxygen to the annular chamber including a plenum air entrance located near the upper base of the housing substantially on the axis of the annular chamber and means for moving the source of oxygen from the plenum air entrance to the annular chamber at a location near the lower base of the inlet plenum, and (D) baffling means in the annular chamber creating a circuitous acoustic path therearound of length greater than the outer perimeter of the annular chamber.

* * * * *